United States Patent [19]

Jenkins et al.

[11] Patent Number: 4,606,112

[45] Date of Patent: Aug. 19, 1986

[54] METHOD OF ASSEMBLING A REFRIGERATOR CABINET

[75] Inventors: Thomas E. Jenkins; Robert R. Sisler, both of Louisville, Ky.

[73] Assignee: General Electric Company, Louisville, Ky.

[21] Appl. No.: 749,820

[22] Filed: Jun. 28, 1985

[51] Int. Cl.[4] ..... B23Q 3/00

[52] U.S. Cl. ..... 29/464; 29/509; 29/522 A; 29/526 A; 29/526 R; 312/214

[58] Field of Search ..... 29/464, 526 R, 509, 29/522 A, 526 A; 312/214, 296, 326; 248/221.3; 220/9

[56] References Cited

U.S. PATENT DOCUMENTS

| | | | |
|---|---|---|---|
| 1,872,616 | 8/1932 | Andren . | |
| 2,845,321 | 7/1958 | Saunders | 312/214 |
| 3,240,029 | 3/1966 | Wurtz | 312/214 X |
| 3,290,109 | 12/1966 | Vanegas | 312/214 X |
| 3,300,850 | 1/1967 | Steuernagel | 29/432.1 |
| 3,601,463 | 8/1971 | Watt | 312/214 |
| 3,868,152 | 2/1975 | Dixon | 312/214 |
| 3,906,776 | 9/1975 | Humphreys et al. | 29/526 A X |
| 4,050,753 | 9/1977 | Scherrer | 312/214 X |
| 4,057,892 | 11/1977 | White | 29/526 R |
| 4,170,391 | 10/1979 | Battger et al. | 312/214 |
| 4,295,765 | 10/1981 | Burke | 410/101 |
| 4,348,068 | 9/1982 | Hawkins et al. | 312/214 X |
| 4,397,224 | 8/1983 | Walker | 29/526 R X |

FOREIGN PATENT DOCUMENTS

| | | | |
|---|---|---|---|
| 2141562 | 2/1973 | Fed. Rep. of Germany | 312/214 |
| 622086 | 4/1949 | United Kingdom | 312/214 |

*Primary Examiner*—Charlie T. Moon

*Attorney, Agent, or Firm*—Frank P. Giacalone; Radford M. Reams

[57] ABSTRACT

A refrigerator cabinet having an outer metal case including side walls and a top wall, a plastic inner liner and a partition separating a freezer and fresh food compartments and separate front door openings. A front face is formed along the front edge of the side and top wall defining the door openings. The front face on each side wall is provided with a pair of vertically spaced openings. A support bar including a pair of vertically spaced openings dimensioned to align with the openings in the front face is secured relative to the front face adjacent each side wall. A cross member extending between the side walls is positioned adjacent the front portion of the partition. The cross member includes a pair of vertically spaced openings adjacent each end thereof which are cooperatively arranged relative to the pair of vertically spaced openings in the front face and support bar. Securing means cooperating with the aligned vertically spaced openings in the front face, support bar and cross member forming a locked joint which securely holds the cross member substantially perpendicular relative to the cabinet side walls to thereby insure that the side walls and the cross member defining the front door openings are maintained in a substantially perpendicular relationship.

4 Claims, 7 Drawing Figures

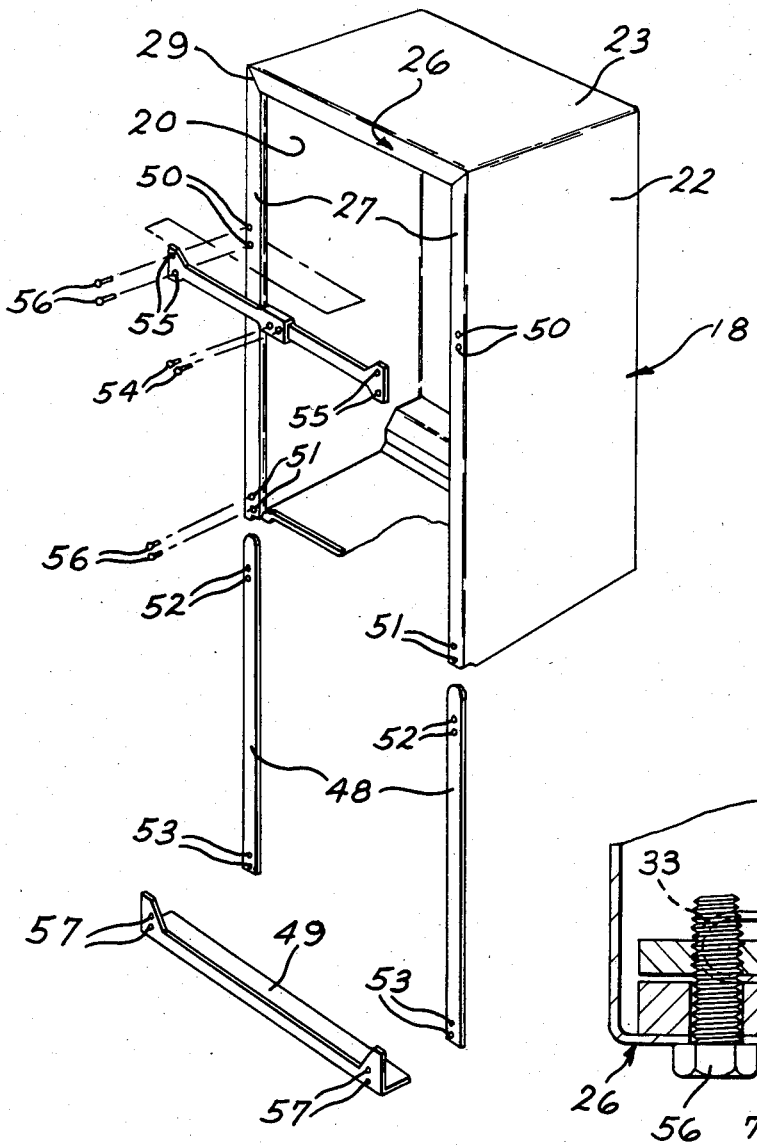
FIG. 3
FIG. 7
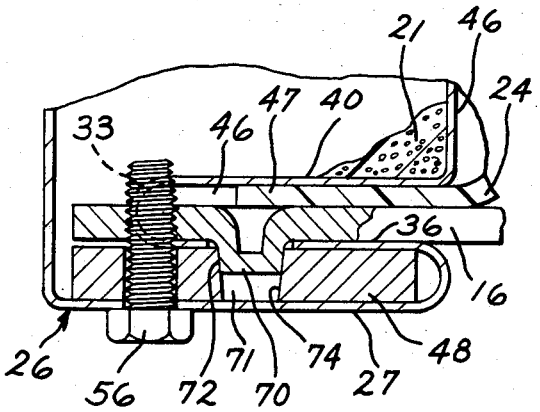
FIG. 4
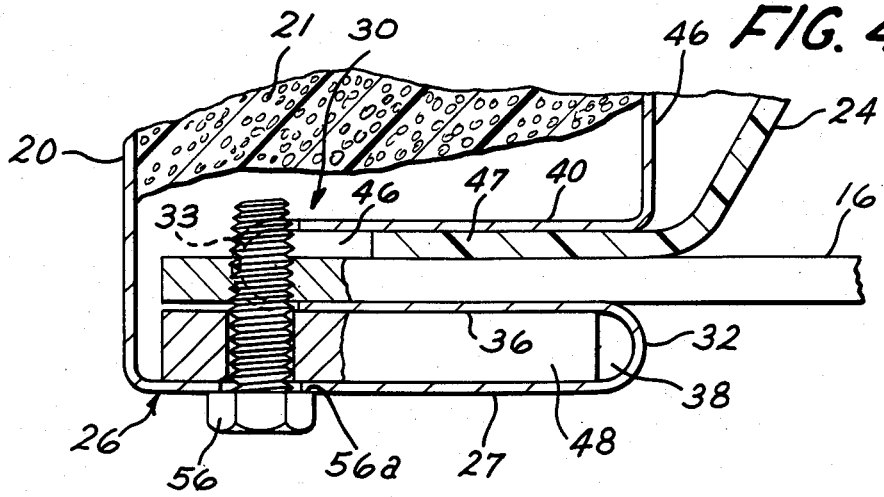

METHOD OF ASSEMBLING A REFRIGERATOR CABINET

CROSS REFERENCE TO RELATED APPLICATIONS

This application is related to concurrently filed application Ser. No. 749,801, to Sanuel J. Woolley and Thomas E. Jenkins, and Ser. No. 747,821, to Thomas E. Jenkins and Donald S. Cushing, each assigned to the General Electric Company, the assignee of the present invention.

BACKGROUND OF THE INVENTION

In the construction of a household refrigerator it is often desirable to provide a partition within the refrigerator for separating the refrigerator into a freezer compartment and a fresh food compartment. It is further desirable to have the partition constructed in such a manner that there is a mullion across the front of the partition and secured to the cabinet outer case to afford a pleasing appearance. The freezer and fresh food compartments are in many cases closed by separate access doors which are hingedly attached to the cabinet outer case. For the pleasing appearance of the mullion and the proper fit of the doors for the freezer and fresh food compartments it is important that the width of the refrigerator cabinet be maintained and that the loads on the door do not produce excessive deflection of the structure, and further that the door openings are square and more importantly remain square under normal or design loads imposed on the cabinet.

Generally household refrigerators normally employ a sheet metal outer casing and an inner liner with a resin foam insulation medium interposed therebetween. The foam or polyurethane compositions in liquid/gas form are introduced into the space between the outer casing and inner liner, expand throughout the space and then are solidified by curing. In practice this solid foam which inherently adheres to both the outer case and inner liner adds a rigidity to the cabinet structure. This added rigidity by the employment of foam insulation has enabled manufacturers to reduce the thickness of the cabinet outer shell. In some instances due to uneven floors or the force placed on the cabinet by weight of the doors the cabinet will deflect. This deflection in some instances will cause a misalignment of the door wherein proper closure of the cabinet is impossible. It has been determined that when a cabinet deflects due to its being positioned on an uneven floor or excessive door loading the foam insulation between the outer case and liner tends to creep. The foam insulation will set in its deflected position thereby causing the cabinet to form a permanent parallelogram as the cabinet conforms to the floor.

This problem is further present when the refrigerator door is dimensioned relative to the cabinet to carry relatively large items such as one gallon milk containers and other large items. These larger items may present a weight increase of 50% over customary doors, and when stored on the door shelves can exert a large force on the hinge side of the cabinet. This force when excessive together with an uneven floor can cause the hinge side of the cabinet to sag and the cabinet frame to deflect and form a parallelogram. In this situation the door would be difficult to close and in some cases impossible.

Accordingly, by the present invention means are provided to insure that the cabinet door openings remain square under the forces applied by the weight of the doors on the cabinet frame and uneven floors.

SUMMARY OF THE INVENTION

By the present invention there is provided a refrigerator cabinet of the type having an outer metal shell with side walls interconnected by a top wall and a front face which an inner liner and a partition separating a freezer and fresh food compartments is arranged. In carrying out the present invention the outer cabinet was constructed of pre-painted metal having a thickness of between 0.019 and 0.021. The front face, which is formed adjacent the side walls and top wall, includes spaced first and second wall portions. The front face and first wall portions adjacent the side walls are provided with a pair of vertically spaced aligned apertures.

A suport bar having a pair of vertically spaced apertures therein is arranged between the front face and the first wall so that the apertures in the support bar align with the aligned apertures in the front face. A metal cross member having a pair of vertically spaced fastener opening at each end thereof being spaced a distance such that they communicate with the pair of vertically spaced aligned apertures on the front face and the support bar. The vertically spaced apertures of the support bar includes an opening having a circumferential chamfer. Whereby when the cross member is secured to the front face by drawing the cross member, mounting bracket, first wall portion and front face together a portion of the front face is drawn into the chamfer. Accordingly, a locked joint is formed between the cross member and the cabinet side wall which insures that the cross member and cabinet side walls are maintained in a substantially perpendicular relationship.

BRIEF DESCRIPTION OF THE DRAWINGS

FIG. 3 is an exploded perspective view of the refrigerator cabinet showing parts of the present invention prior to assembly;

FIG. 4 is a sectional plan view taken along line 4—4 of FIG. 1 showing one embodiment of the present invention;

FIG. 7 is a sectional plan view similar to FIG. 5 showing still another embodiment of the invention.

DESCRIPTION OF THE PREFERRED EMBODIMENT

Figure 1:
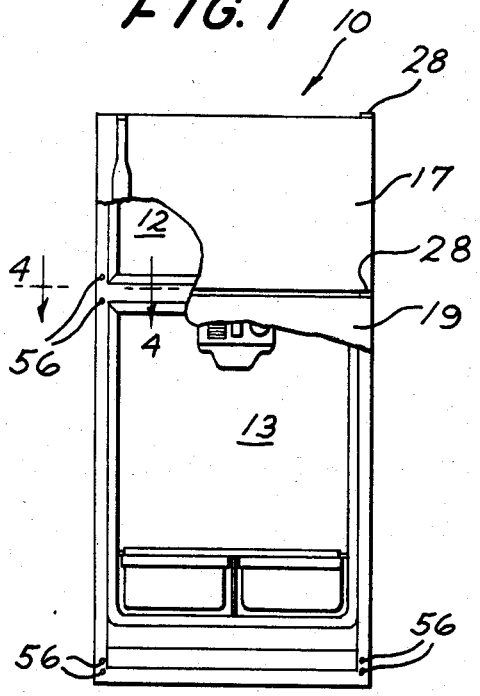
FIG. 1 is a schematic front elevational view of a refrigerator incorporating the present invention.
Figure 2:
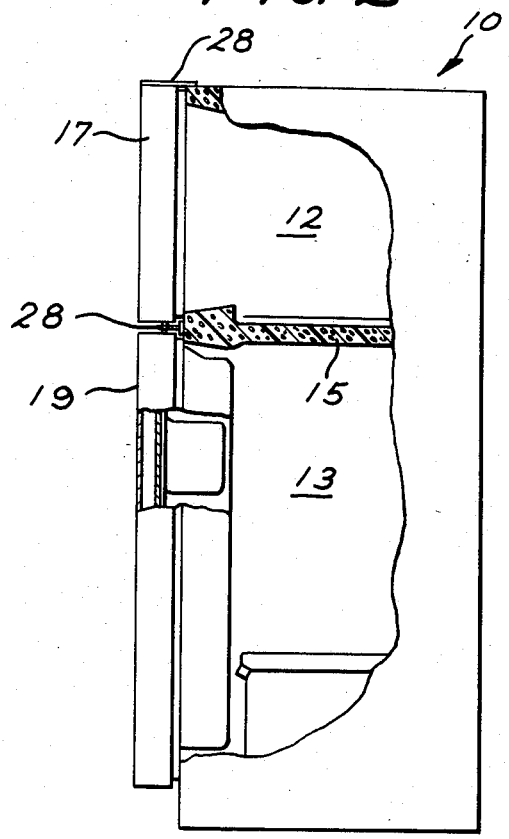
FIG. 2 is a schematic side elevational view of the refrigerator.

Referring to FIGS. 1 and 2, a refrigerator 10 such as a top mount household refrigerator, for example, one having a freezing compartment 12 and a fresh food compartment 13 separated by an insulation partition assembly 15. Positioned in front of the insulation partition assembly 15 is a mullion component or strip 16 (FIG. 3) which, as will be explained fully hereinafter, insures the proper orientation of the side walls and prevents deflection of structure due to door loads of the cabinet. The partition assembly 15 and the manner in which it is assembled to the cabinet is fully disclosed and described in pending application for patent Ser. No. 622,257, filed June 19, 1984, now U.S. Pat No. 4,558,503, Arthur C. Wilson, assigned to General Electric Company, the assignee of the present invention. The partition does not form a part of the present invention and accordingly will not be described in detail herein. Upon completion of the assembly of the refrigerator the freezer compartment and fresh food compartments would have separate doors 17 and 19 respectively for closing the respective compartments. The refrigerator 10 has a cabinet outer metal case or shell 18 that has opposite side walls 20, 22, a top wall 23, and a bottom wall 25 which envelops both the freezer and fresh food compartments. The outer metal shell 18 has an interior liner 24 (FIG. 5) which is made of sheet metal or plastic material. Between the inner liner and outer metal shell 18 (FIG. 5) there is insulation 21. This insulation in many refrigerators consists of polyurethane foam which is in liquid form and inserted or injected into the space between the outer metal shell 18 and the interior liner 24 and then cured in place. During the polyurethane foaming operation the outer metal shell 18 may bulge or bow outwardly and thus cause some distraction of the side walls 20 and 22 of the outer metal shell 18. It is desirable that the bowing or bulging of the outer shell when it occurs be corrected and eliminated prior to the final assembly of the refrigerator so that the insulation partition assembly 15 fits correctly relative to the side walls of the liner 24 with no gaps between those components. Moreover, when the doors 17 and 19 of the freezer compartment and fresh food compartment are hung it is again important that the case dimensions from one side 20 to the other side 22 be the same throughout the height of the refrigerator and that the door openings defining the freezer and fresh food compartment remain square so that the doors align and seal the front openings to the compartments 12 and 13 correctly.

Figure 5:
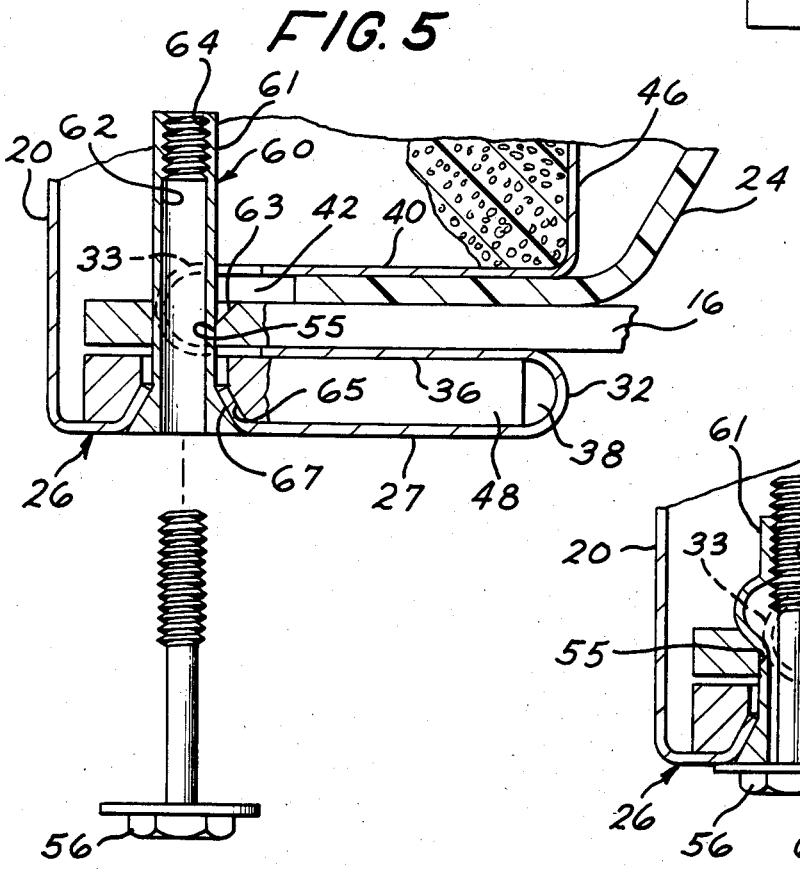
FIG. 5 is a sectional plan view similar to FIG. 4 of another embodiment showing various parts prior to assembly into the completed cabinet.
Figure 6:
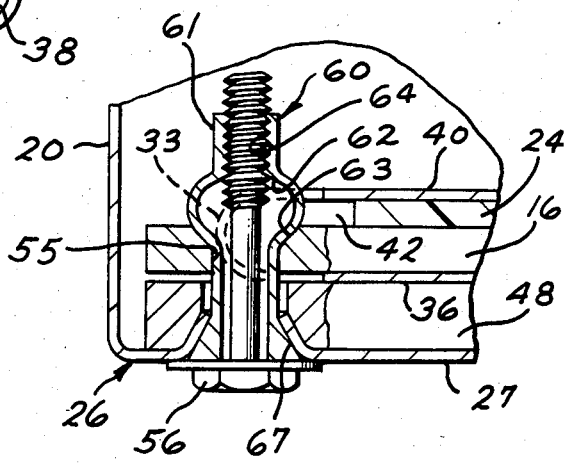
FIG. 6 is a sectional plan showing the embodiment of FIG. 5 assembled.

With particular reference to FIGS. 3–5, the components and their arrangement involved with the method of assembling the refrigerator cabinet will be discussed. While only one side of the refrigerator is shown in FIGS. 4–6, it is to be understood that the other side of the refrigerator will have the same components and arrangement. Prior to the foaming operation to provide the insulation 25 between the outer metal shell 18 and interior liner 24, the outer shell is formed to provide a front face 26 including side wall portions 27 interconnected by a top wall portion 29 against which the doors of the freezer and fresh food compartments would engage and seal. The hinges 28 for the doors may be mounted on either of the side portions 27. The front face extends along both side walls and the interconnecting top wall. The outer shell 18 in the present embodiment is fabricated from pre-painted metal having a thickness generally between 0.019 and 0.021. This use of relatively thin sheet metal requires that means be incorporated in the cabinet construction which will insure against deflection. The cabinet door openings defined by front face 26 may distort out of square if use of the side portions sags relative to the other which results in the frame forming a parallelogram. A side portion may sag for example when forces are exerted on the cabinet when it is placed on an uneven floor or when an excessive weight is placed on the door. This is especially true in cabinets having relatively deep door shelves that are designed to hold heavy items such as one gallon milk containers. Formed relative to the front face 26 of the cabinet and more particularly the side and top portions 27,29 respectively is a flange 30 depending inwardly from the front face 26 which has an S shape. The flange 30 includes a first reverse bend 32, a second reverse bend 33, providing a first wall portion 36 and recess 38 between portion 27 and wall 36 and second wall portion 40 and recess 42 between wall 36 and wall 40. Each of the walls 36 and 40 being substantially parallel to front wall portion 27. A right angle bend 44 at the end of wall 36 provides a rearwardly extending wall 46. The wall 46 is spaced from the side wall 20 to allow the foam to have access to that area of the outer case. Prior to the foaming operation the liner 24 is arranged in the cabinet in spaced relationship to the other walls thereof with the peripheral edge 47 of the interior liner 24 inserted into recess 42 as shown in FIG. 5.

To further strengthen the cabinet a support frame is assembled to the cabinet including the cross member 16, backup plates or support bars 48 and a lower cross member 49.

The pair of support bars 48 which are a strong rigid metal strip are, as shown in FIGS. 3–6, located in the recess 38 between the front face wall 26 and wall 36 of each side wall portion 27. The upper and lower cross members 16 and 49 as will be explained fully hereinafter are secured perpendicular relative to the mounting bars 48 and cabinet front face 26 in a manner which insures that they remain perpendicular to the side portions 27 of cabinet front face 26. This arrangement, as will be explained hereinafter, prevents deflection of the cabinet and insures that the door openings remain square. With reference to FIG. 3, it will be seen that the side front wall portions 27 are provided with upper and lower pairs of vertically spaced openings 50 and 51 respectively which are aligned with cooperating openings in the first wall 36. The mounting bars 48 are formed with vertically spaced pairs of upper and lower openings 52 and 53 which are spaced to align with openings 50 and 51 respectively when the bars are positioned in the recess 38 as shown in FIGS. 5–6. The bars 48 as will be explained below add considerable strength to the area where the mullion strip 16 and lower member 49 are connected to the side walls 20, 22 of the cabinet. Mullion component 16 and one of the mounting bars 48 as shown in FIG. 5 are used to mount the door hinges 30 arranged between the upper and lower doors. As thus far described the refrigerator cabinet with the mounting bars 48 arranged with openings 52 and 53 aligned with openings 50 and 51 respectively is then processed through the insulation foaming operation. The bars 48 are dimensioned to take up the full width of the recess 38 so as to thereby prevent foam insulation from passing through openings 50, 51 as the foam expands into the area between wall 46 and side walls 20 and 22.

As mentioned above as a result of the foaming operation and its expansion through the area between the cabinet outer walls and the inner liner cabinet may tend to bulge. That is, the side face walls 27 may deviate or bulge from their intended paralleled position and accordingly present a problem in properly fitting doors and other components necessary to complete the refrigerator. Further, the doors in the illustrative embodiment are relatively deep and are dimensioned to accomodate large items and accordingly it may be possible for the doors to be loaded so they will carry a considerable amount of weight and accordingly cause the cabinet side frame to sag. The sagging of the cabinet side wall under influence of door weight can cause the cabinet to distort from a square or rectangle to a parallelogram. It should be noted that the foam insulation generally adheres to both the inner liner and cabinet, accordingly if the cabinet deflects due to an uneven floor or excessive loading, the foam insulation will creep and distort. After a period of time the insulation will set in the distorted position causing the cabinet to permanently set in its deftlected or distorted position.

Means are further provided to insure that the cabinet front face remain rectangular and that its side walls are positioned and maintained at the correct cabinet width with the door openings square. The mullion component 16 in the present embodiment as shown in FIG. 3 is two piece member joined at the center. The two piece arrangement facilitates the insertion of the end portion of component 16 into the recess 42 as shown in FIGS. 4 and 6. Once the end portions are positioned in the recess 42 the two pieces are then secured by fastening means 56 so the component 16 is maintained at its predetermined proper length. With the component 16 fixed at its proper length the vertically spaced threaded openings 55 located adjacent each end are aligned with the vertically spaced apertures 50 so that the cabinet will be at its correct width. Mounting bars 48 at this point in time have been foamed into the cabinet with the vertically spaced pair of openings 52 and 53 aligned with the vertically spaced pair of openings 50 and 51 respectively. The component 16 is secured by threaded fasteners 56 which pass through openings 50 in wall 27 and openings 60 in mounting bar 48 to engage threaded openings 55 in component 16. As shown in the drawings the mounting bar 48 and wall portions 36 are sandwiched between the cross member 16 and fastener 56. This arrangement including the vertically spaced pair of openings secures the component 16 relative to the cabinet so that it will not pivot and in fact it will remain perpendicular relative to the side wall of the cabinet under forces which may be applied thereto.

The lower cross member 49 is secured to the cabinet similar to component 16; that is, its end portions are arranged in the recess 42. The ends of the member 49 are provided with vertically threaded spaced openings 57 (FIG. 3) which align with openings 51 in the cabinet front, wall 27 and opening 53 in the lower end of the bars 48. The lower cross member 49 is at this time secured to the cabinet by threaded fastening elements 58 which, like the action of fastener 56 described above, pass through openings 51 in cabinet wall 27 and openings 53 in mounting bar 48 to engage the threaded openings 57 of member 49. The mounting bar 48 and wall portions 27 and 36 are sandwiched between the cross member 49 and fastener 58. This arrangement effectively secures the cross member 49 relative to the mounting bars 48 and wall portion 27 of the front face together in a manner which prevents pivoting of the member 49 relative to the cabinet side walls. By vertically spacing each cooperating pairs of apertures of the cabinet wall 27, mounting bars 48 and those of cross members 16 and 49 respectively as described above, pivoting action of either the mullion component 16 or cross member 49 relative to the cabinet front face is prevented. As long as members 16 and 49 remain perpendicular to the side walls the cabinet will not deflect. Means are further provided to insure that movement between the fastening element 56 and 58 and the apertures they pass through is minimized.

By the present invention a locked joint is provided between the fastening elements 56 and 58 and the apertures they pass through so that zero motion is achieved between the members 16 and 49 and the cabinet side walls. While the locked joints of the present invention are applicable to both the members 16 and 49 as they are secured to the cabinet side walls, the following description will be limited to the member 16 and its connection to the cabinet side walls.

With reference to the embodiment shown in FIG. 4, the upper and lower apertures 50, 51 respectively in the cabinet side walls are dimensioned to allow the fasteners 56 to pass therethrough. In this embodiment the fastener 56 is of the roll tapping type. This type of roll tapping fastener is available from the CAM-CARR Co. and sold by the name "TAP TIGHT." The openings 52 in the bar 48 are dimensioned to permit the fastener 56 to pass therethrough. The openings 55 in member 16 are dimensioned to cause fastener 56 to roll tap the threads in aperture of member 16. The roll tap action of the fasteners 56 in this embodiment results in a relatively tight fit since the threads are not cut out of the material of bar 48 but rather formed therein. This action affects a locked joint between member 16 and the bar 48 and accordingly between member 16 and the cabinet side walls. In this instance the wall portions 36, bar 48, and wall 27 are sandwiched between the head portion 56*A* of fastener 56 and the member 16 by the lock joint formed by the engagement of the parts as shown.

With reference to the embodiment shown in FIGS. 5 and 6, there is shown a locked joint wherein the removal of the fastener 56 will not affect the locked joint arrangement between the member 16 and the cabinet side walls. To this end the apertures 50 in the cabinet side walls and the apertures 52 in the bar 48 and member 16 respectively are dimensioned to recieve a sleeve member 60 having a passageway 63 extending therethrough . In this embodiment the member 16 adjacent the aperture 55 is formed with a recess 63, while the face portion of the bar 48 adjacent aperture 50 in the wall portion 27 is also formed wiith a recess 65. A portion of 27 adjacent apertures 50 is drawn into the recess 65 by a cooperating projection 67 formed on the sleeve member 60. The end portion 61 of passageway 62 of sleeve member 60 extending through the member 16 is formed with threads 64. Accordingly, as the fastener 56 engages the threads 64 it pulls the portion 61 toward the wall 27. Continuous tightening action by fastener 56 on the sleeve 60 causes the portion of the sleeve intermediate the member 16 and portion 61 to mushroom or bulge outwardly into the recess 63 while at the same time projection 67 is drawn into recess 65. This action of the mushrooming of the sleeve 60 into the recess 63 and the clamping of wall 27 adjacent aperture 50 between the recess 65 and projection 67 causes the member 16 wall portions 36, 40 and bar 48 to be sandwiched between the mushroomed portion of sleeve member 60 and the projection 67 of sleeve member 60.

It should be apparent that in this embodiment the fastener 56 may be removed without impacting on the locked joint formed between the member 16 and the cabinet side walls. In this configuration the fastener 56 may be removed for the purpose of securing the hinge 28 relative to the cabinet.

With reference to the embodiment shown in FIG. 7, it will be seen that the basic lock joint is similar to that disclosed in FIG. 4. In this instance to further insure the integrity of the locked joint the member 16 is formed to include projections 70 adjacent each of the fasteners 56. The projections 70 are formed with inclined walls 72 that are dimensioned to be recieved in openings 71 formed in the bar 48. The openings 71 also include inclined walls 74 which cooperatively engage with the walls 72 of projection 70. The first wall portion 36 is also formed with an opening - which as shown aligns with the projection 70 and opening 71 in member 16 and base 48 respectively. In this instance the projection 70 is securely positioned in the opening 71 of bar 48 to further ensure that a locked joint is affected between the member 16 and cabinet side walls.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is :

1. A method of assembling a refrigerator cabinet of the type having on outer metal shell with side walls and a front face, an inner liner and a partition separating a freezer and fresh food compartments comprising:

forming said front face to include spaced first and second wall portions parallel to said front face;

providing vertically spaced aligned apertures in said front face and said first wall portion;

forming a metal cross member having fastener openings at each end thereof spaced vertically a distance such that when said fastener openings are aligned with said aligned apertures said outer metal shell will have the correct cabinet width;

inserting a mounting bracket having apertures therein between said front face and said first wall such that the apertures in said mounting bracket communicate with said aligned apertures in said first wall portion and said front face;

inserting fastening means in said aligned apertures for securing the cross member to said front face by sandwiching said cross member, mounting bracket, first wall portion and front face together to form a locked joint between said cross member and said cabinet to thereby insure that said side walls and said cross members are maintained in a substantially perpendicular relationship.

2. The method of assembling a refrigerator cabinet according to claim 1 further providing said fastening means wherein insertion of said fastening means in said aligned apertures causes said fastening means to roll tap threads in said cross member.

3. The method of assembling a refrigerator cabinet according to claim 1 further providing a hollow sleeve member insertable in said aligned apertures having a head portion on one end and threads at the other end thereof, inserting said fastening means in said hollow sleeve member whereby said sleeve member is collapsed to sandwich said cross member, mounting bracket, front wall portion and front face between said collapsed and head portion of said sleeve member.

4. The method of assembling a refrigerator cabinet according to claim 1 for the providing locking means engagable between said cross member and said mounting bracket whereby a locked joint is affected therebetween.

* * * * *